US007854084B1

(12) United States Patent
Rutherford

(10) Patent No.: US 7,854,084 B1
(45) Date of Patent: Dec. 21, 2010

(54) AR15-T400 HOOK-UNDER TRIGGER ASSEMBLY

(76) Inventor: Floyd D. Rutherford, 808 E. Cedar St., Bristol, TN (US) 37620

( * ) Notice: Subject to any disclaimer, the term of this patent is extended or adjusted under 35 U.S.C. 154(b) by 0 days.

(21) Appl. No.: 12/589,767

(22) Filed: Oct. 28, 2009

Related U.S. Application Data

(63) Continuation-in-part of application No. 12/228,103, filed on Aug. 11, 2008, now abandoned.

(60) Provisional application No. 60/964,021, filed on Aug. 9, 2007.

(51) Int. Cl.
*F41A 19/00* (2006.01)

(52) U.S. Cl. ..... 42/69.01; 42/69.02; 42/69.03; 89/136

(58) Field of Classification Search ..... 42/69.01, 42/69.02, 69.03; 89/140, 139, 136
See application file for complete search history.

(56) References Cited

U.S. PATENT DOCUMENTS

| | | | | | |
|---|---|---|---|---|---|
| 5,881,485 | A * | 3/1999 | Milazzo | ..... | 42/70.08 |
| 6,131,324 | A * | 10/2000 | Jewell | ..... | 42/69.03 |
| 6,615,527 | B1 * | 9/2003 | Martin | ..... | 42/69.03 |
| 6,772,548 | B1 * | 8/2004 | Power | ..... | 42/69.03 |
| 7,331,136 | B2 * | 2/2008 | Geissele | ..... | 42/69.03 |
| 7,421,937 | B1 * | 9/2008 | Gangl | ..... | 89/142 |
| 7,600,338 | B2 * | 10/2009 | Geissele | ..... | 42/69.03 |
| 2007/0006510 | A1 * | 1/2007 | McCormick | ..... | 42/75.02 |

* cited by examiner

*Primary Examiner*—Michael Carone
*Assistant Examiner*—Gabriel J Klein

(57) ABSTRACT

A disconnector for a rifle wherein the disconnector is formed with a hook-under portion which is provided with a sharp trigger body contact ridge which contacts on a center line (rifle longitudinal axis) of the underside of a portion of the trigger body when the disconnector is in a neutral position during the first stage of a two stage trigger pull.

2 Claims, 4 Drawing Sheets

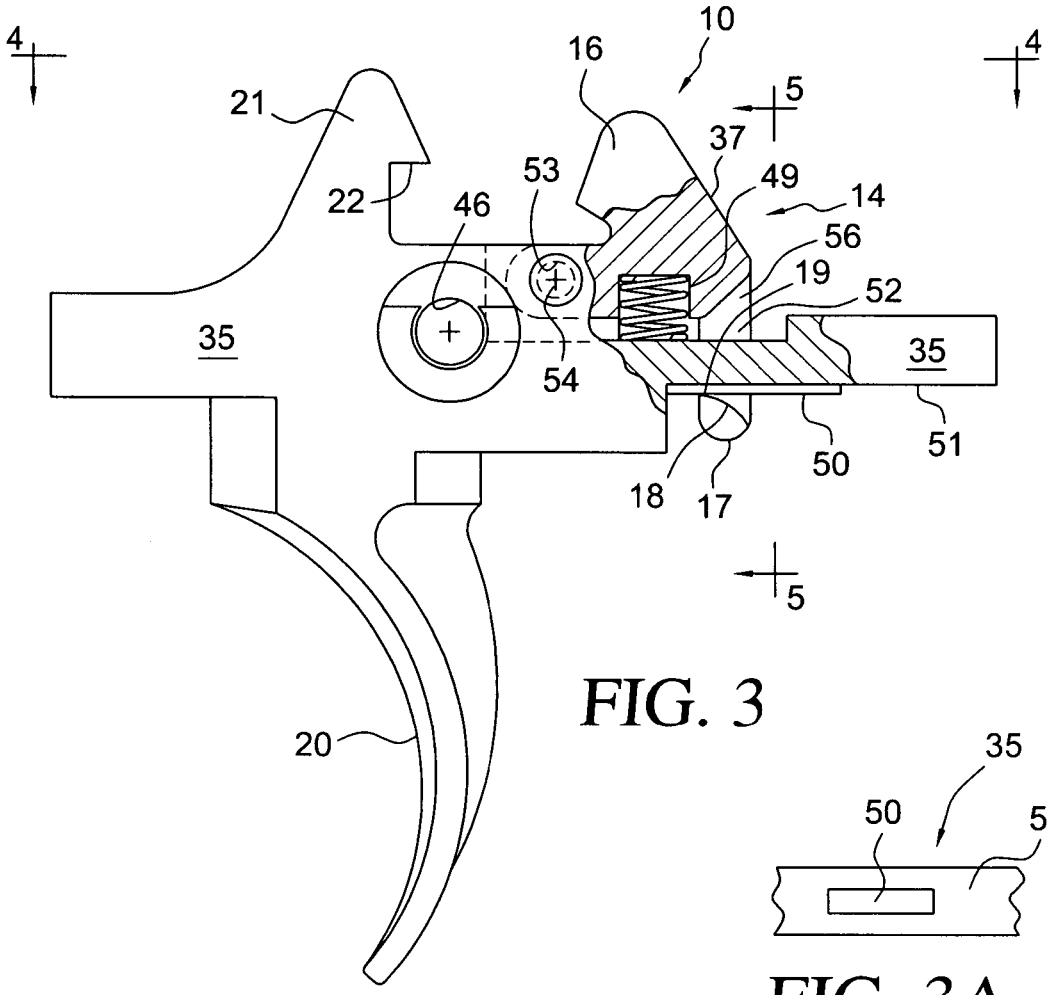
FIG. 3
FIG. 3A
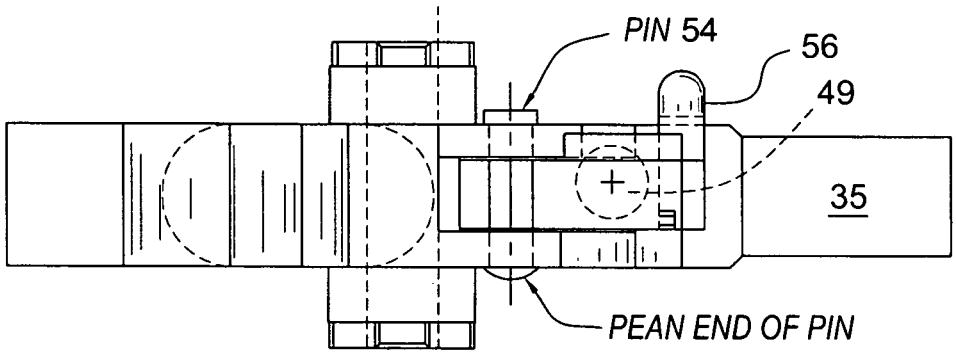
FIG. 4

AR15-T400 HOOK-UNDER TRIGGER ASSEMBLY

This application is a Continuation-In-Part of application Ser. No. 12/228,103 filed Aug. 11, 2008 now abandoned and claims the benefit of the Provisional Patent Application Ser. No. 60/964,021 filed Aug. 9, 2007.

BACKGROUND

1. Field

The technical field of the present invention resides in a unique trigger disconnector structure and its manufacture for firearms and in particular for the AR15-T400 rifle.

2. Prior Art

The current various trigger assemblies on the market such as described in U.S. Pat. Nos. 5,881,485; 6,131,324; 5,501,134; 4,937,964; and 4,937,964 the disclosures of which are hereby incorporated herein by reference in their entireties, do not incorporate a center line trigger pull which allows the disconnector to hook under the trigger body and bear on a lateral, centered pivot line on the trigger body. The present structure allows for more accurate machining of the disconnector and a cleaner, lighter and crisper trigger pull in that it allows the shooter to feel the first and second stages of the trigger pull without any drag or roughness.

SUMMARY

The present disconnector works from the bottom of the trigger body with a hook under portion laterally centered with the trigger body and with a substantially line pivot fulcrum contacting the trigger body. This design allows the disconnector to work freely on the very accurately ground trigger body surface giving a center line trigger pull with less torquing of the trigger pivot giving much less drag and imbalance to the firing process.

BRIEF DESCRIPTION OF DRAWINGS

The invention will be understood further from the drawings herein and their description, wherein:

FIG. 3 is an enlarged side view of the trigger-disconnector assembly of FIG. 1 with portions broken away for clarity;

FIG. 3A is a bottom up view of the trigger body portion lying adjacent to ridge 18 of the disconnector;

FIG. 4 is a top view taken along line 4-4 in FIG. 3;

DETAILED DESCRIPTION

Figure 1:
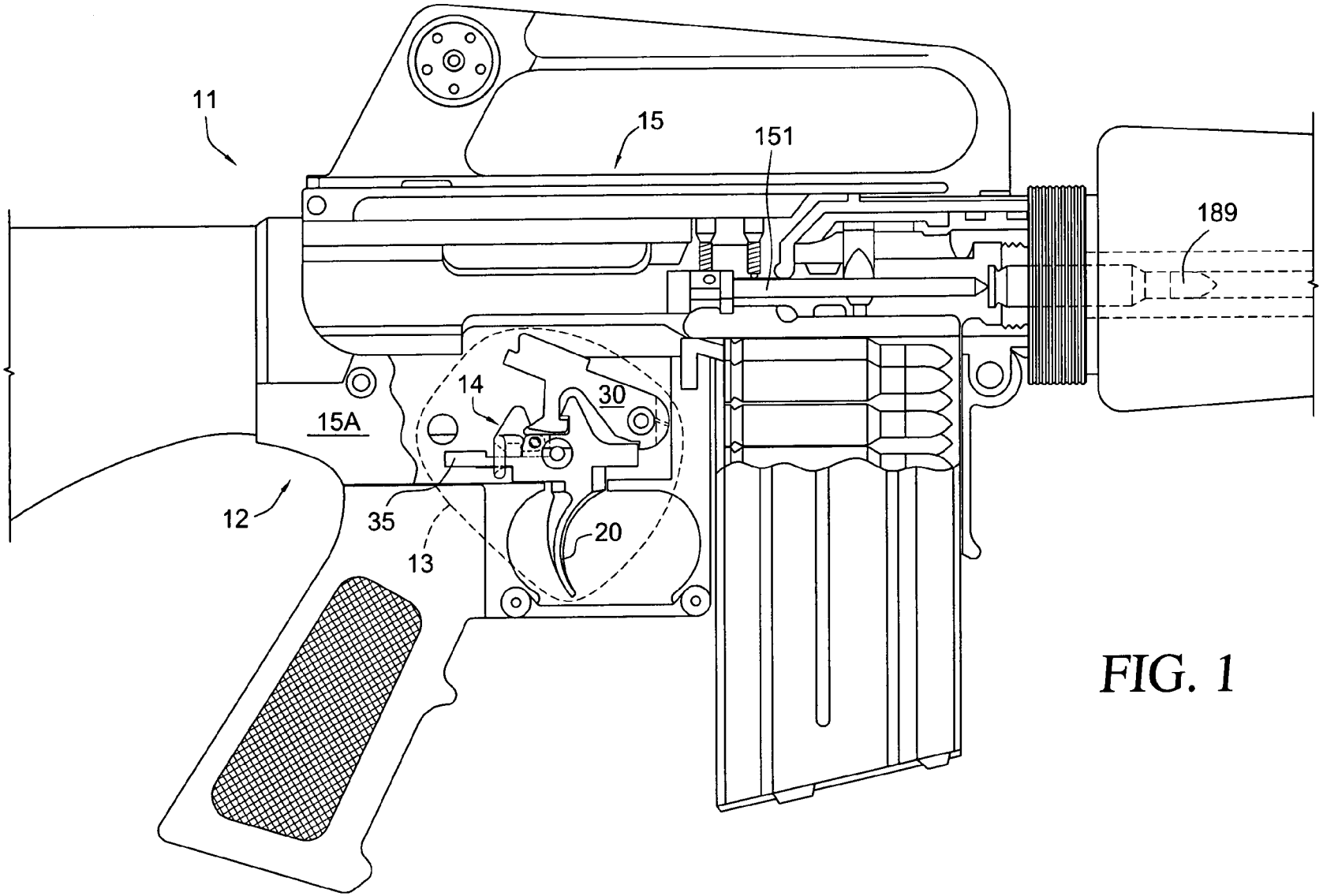
FIG. 1 is a side view with portions broken away for clarity, of a rifle having the present disconnector structure.
Figure 9:
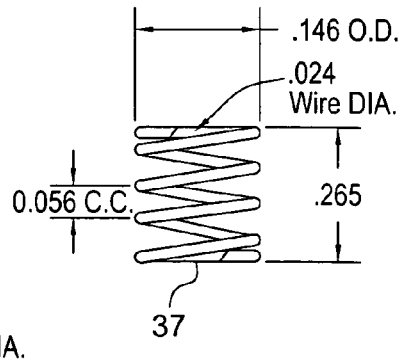
FIG. 9 is a dimensioned (in inches) detail of the disconnector engagement compression spring.

Referring to FIG. 1, an AR15 rifle is shown with side wall portions of the breech 12 housing broken away and showing (within the dotted line) the present trigger-disconnector-safety assembly 13 with certain parts thereof numbered as in the aforesaid FIGS. 9, 10 and 11 of said U.S. Pat. No. 5,501,134.

Figure 2:
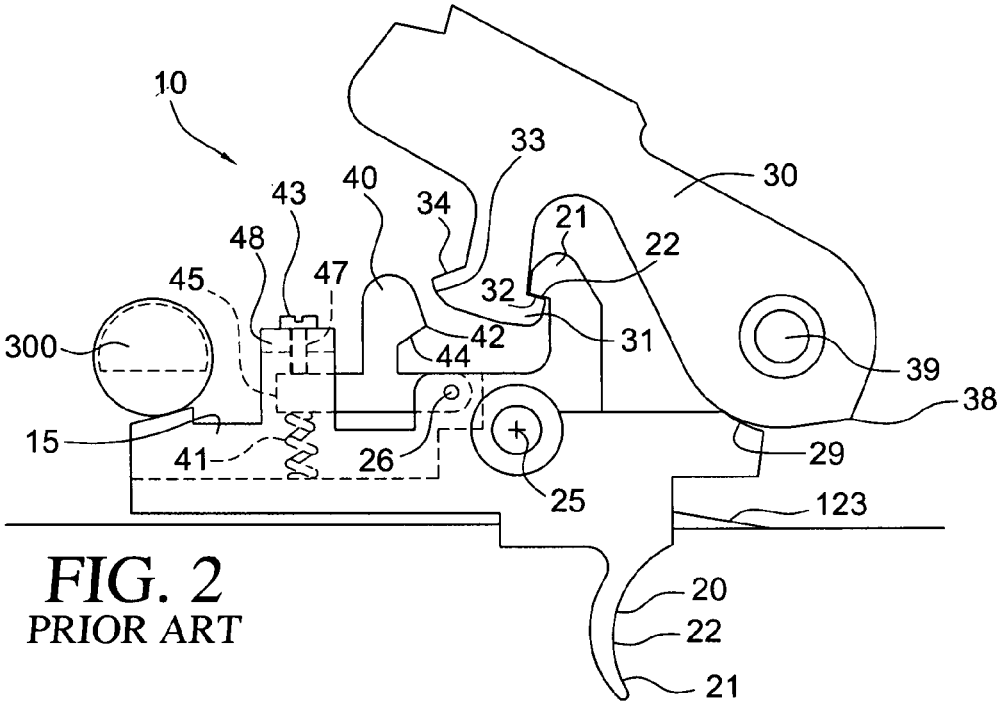
FIG. 2 PRIOR ART
FIGS. 2, 2A and 2B are side views of the prior art (U.S. Pat. No. 5,501,134) trigger-disconnector-safety assembly as shown in FIGS. 9, 10 and 11 respectively of that patent.
Figure 2A:
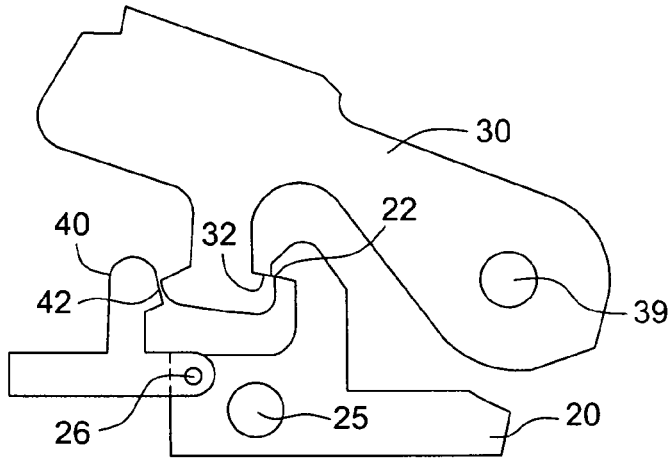
FIG. 2A PRIOR ART
Figure 2B:
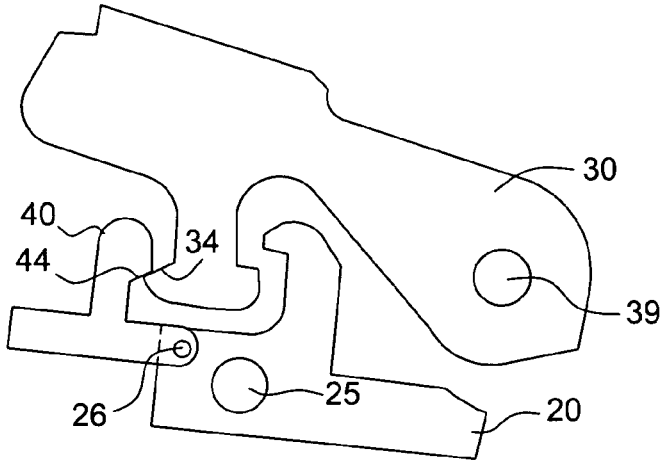
FIG. 2B PRIOR ART
Figure 5:
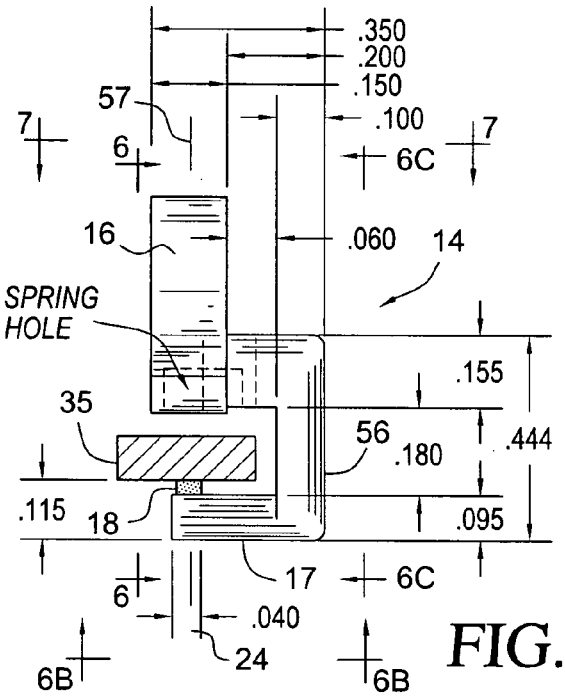
FIG. 5 is a cross-sectional view of the disconnector and adjacent trigger body portion taken along line 5-5 in FIG. 3.
Figure 6:
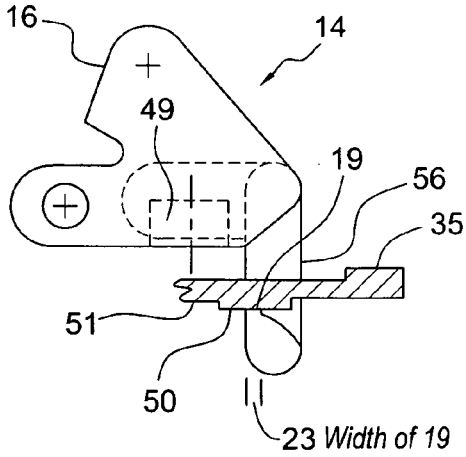
FIG. 6 is a side view of the disconnector and portions of the adjacent trigger body taken along line 6-6 in FIG. 5.
Figure 6A:
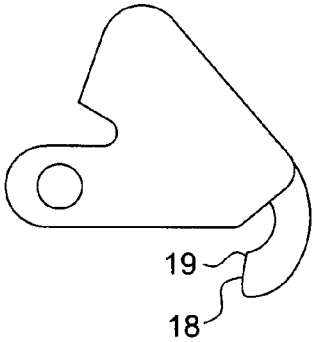
FIG. 6A shows a variation in shape of the hook under portion of the present disconnector while retaining the ridge 18 structure.
Figure 6B:
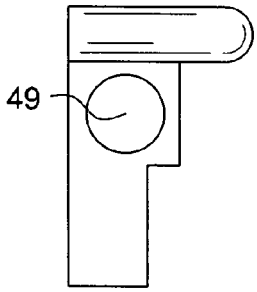
FIG. 6B is a bottom up view taken along line 6B-6B in FIG. 5.
Figure 6C:
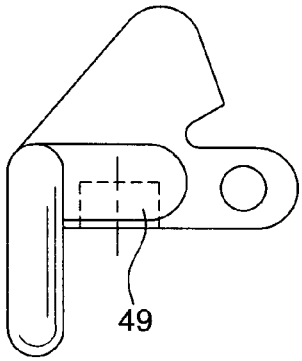
FIG. 6C is a side view taken along line 6C-6C in FIG. 5.
Figure 7:
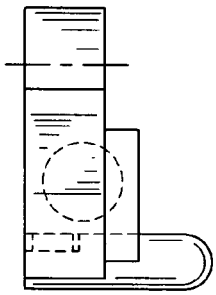
FIG. 7 is a top view of the isolated disconnector taken along line 7-7 in FIG. 5.
Figure 8:
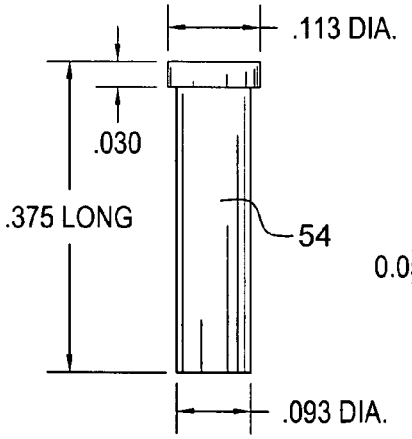
FIG. 8 is a dimensioned (in inches) detail of the disconnector pivot pin.

The present disconnector is a unique improvement over the structures of the prior art as shown for example in present FIGS. 2, 2A and 2B, and the function and need for a disconnector is described in detail in U.S. Pat. No. 5,501,134 at Col. 2, lines 11 thru 67, Col. 3, lines 1 thru 33, Col. 5, lines 7-67, and Col. 6 lines 1-55. Concisely stated, disconnectors allow an experienced shooter to feel a two stage pull of the trigger wherein in the first stage of the finger pull the shooter can readily feel the trigger move but then stop against a disconnector spring resistance, but in the second stage of the finger pull the shooter in overcoming the spring resistance, can barely—if at all—feel motion of the trigger until firing occurs. Greatly improved shooting accuracy is thus achieved.

Referring to FIGS. 3-9 the present disconnector 14 in a most preferred embodiment comprises a cam portion 16 and a hook under portion 17 which is machined to provide a short lateral ridge 18 which terminates in an upper contact surface 19 which preferably is substantially a line surface of from about 0.0001" to about 0.005" in width 23 and from about 0.005" to about 3/16" in length 24, most preferably from about 0.01" to about 1/8" in length.

Disconnector 14 is pivotally mounted on trigger body 35 by pin 54 and compression spring 37 has one end mounted in pocket 49 in the disconnector and the other end bearing against trigger body 35. As more clearly seen in FIGS. 3A and 6, trigger body 35 preferably but not necessarily is formed with a raised slave portion 50 which can be readily machined ground to precisely adjust the neutral position of cam portion 16 without trying to dimension the whole under cut surface 51 of the trigger body 35.

In a preferred embodiment the invention comprises a firearm trigger assembly having a receiver housing 15A, a firing pin hammer 30 pivotally mounted in the housing and having a hook 31 formed with a trigger engagement surface 32, a trigger 20 having a body 35 pivotally mounted in the housing and having a hook 21 formed with a hammer engagement surface 22 and having an under cut surface 51, a disconnector 14 pivotally mounted on the trigger body 35 and having an upper cam portion 16, a lower hook-under portion 17 and an intermediate connector portion 56 forming a trigger body receiving gap 52, the disconnector having a center line 57 substantially aligned with a longitudinal axis of the firearm, the hook-under portion 17 being formed with a laterally extending ridge 18 on its upper surface, the ridge having an upper contact surface 19 of a width of from about 0.0001" to about 0.05" and a length of from about 0.01" to about 1/8", and spring means urging the disconnector in a pivotal motion to move cam portion 16 toward said hook 21 and to engage upper contact surface 19 with the under surface 51 of the trigger body 35, wherein at least a portion of the contact surface 19 is positioned on the center line.

In manufacturing the present Hook0Under Trigger Assembly two investment castings are used. The castings material is 8620 steel and the heat treatment required is a case hardened 50-55 with a core depth of 0.010"-0.015". Referring to FIG. 3, this view shows the trigger with a large pin hole 46 machined to 0.156" and a disconnector pin hole 53 drilled and reamed to 0.094". The under cut surface 51 on the bottom of the trigger is 0.110" from the bottom of the disconnector slot. FIG. 4 shows the 0.155" spring pocket 49 in the disconnector to the depth of 0.275" and the 0.094" pin 54 braded in place. The disconnector working surface (slave portion, if used) 50 on the bottom of the trigger body 35 is ground to 0.110"+0.001"-0.001". The angle on the disconnector hook is a clean square ground surface with a tolerance of 0.001".

Assembly Procedure

The present Trigger Assembly is placed in the AR15 receiver by breaking open the receiver by pressing the lower receiver locking pin and swinging the barrel assembly up. Then remove both the hammer and the trigger pins from the side of the receiver. Remove hammer and trigger from the receiver. The AR15-T400 comes completely assembled. Replace the old hammer and trigger with the AR15-T400 set by dropping the trigger in place and inserting the trigger pin. Then place the hammer in the receiver and insert the hammer pin. Lower barrel assembly and lock in place with lower receiver locking pins. The AR15-T400 will now function.

The invention has been described in detail with particular reference to preferred embodiments thereof, but it will be understood that variations and modifications will be effected within the spirit and scope of the invention.

I claim:

1. A firearm trigger assembly having a receiver housing, a firing pin hammer pivotally mounted in said housing and having a hook formed with a trigger engagement surface, a trigger having a body pivotally mounted in said housing and having a hook formed with a hammer engagement surface and having an under surface, a disconnector pivotally mounted on said trigger body and having an upper cam portion, a lower hook-under portion and an intermediate connector portion forming a trigger body receiving gap, said disconnector having a center line substantially aligned with a longitudinal axis of said firearm, said hook-under portion being formed with a laterally extending ridge on an upper surface thereof, said ridge having an upper contact surface of a width of from about 0.001" to about 0.005" and a length of from about 0.01" to about ⅛", and at least one spring urging said disconnector in a pivotal motion to move said cam portion toward said hook and to engage said upper contact surface with said under surface of said trigger body, wherein at least a portion of said contact surface is positioned on said center line.

2. A disconnector for a trigger assembly of a firearm, said disconnector having an upper cam portion, a lower hook-under portion and an intermediate connector portion forming a trigger body receiving gap, said disconnector having a center line adapted to be substantially aligned with a longitudinal axis of said firearm, said hook-under portion being formed with a laterally extending ridge on an upper surface thereof, said ridge having an upper contact surface of a width of from about 0.0001" to about 0.005" and a length of from about 0.01" to about ⅛", and at least one spring adapted to urge said disconnector in a pivotal motion to move said cam portion toward a hook of a firing pin hammer and to engage an upper contact surface with said under surface of a trigger body, wherein at least a portion of said contact surface is positioned on said center line.

* * * * *